US007786374B2

(12) United States Patent
Valli et al.

(10) Patent No.: US 7,786,374 B2
(45) Date of Patent: Aug. 31, 2010

(54) PIANOFORTE INSTRUMENT EXHIBITING AN ADDITIONAL DELIVERY OF ENERGY INTO THE SOUND BOARD, AND METHOD FOR INFLUENCING THE SOUND OF A PIANOFORTE INSTRUMENT

(75) Inventors: Roberto Valli, Ancona (IT); Luigi Lamacchia, Bari (IT); Nikolaus Schimmel, Wolfenbuttel (DE)

(73) Assignee: Wilhelm Schimmel Pianofortefabrik GmbH (DE)

( * ) Notice: Subject to any disclaimer, the term of this patent is extended or adjusted under 35 U.S.C. 154(b) by 0 days.

(21) Appl. No.: 10/553,547

(22) PCT Filed: Apr. 19, 2004

(86) PCT No.: PCT/EP2004/004139

§ 371 (c)(1),
(2), (4) Date: Aug. 4, 2006

(87) PCT Pub. No.: WO2004/094948

PCT Pub. Date: Nov. 4, 2004

(65) Prior Publication Data

US 2007/0079693 A1 Apr. 12, 2007

(30) Foreign Application Priority Data

Apr. 21, 2003 (DE) ..... 103 18 149

(51) Int. Cl.

| | |
|---|---|
| ***G10H 1/02*** | (2006.01) |
| ***G10H 3/18*** | (2006.01) |
| ***G10H 1/32*** | (2006.01) |
| ***G10H 3/00*** | (2006.01) |
| ***H04R 25/00*** | (2006.01) |

(52) U.S. Cl. ..... 84/737; 84/626; 84/726; 84/744; 381/152

(58) Field of Classification Search ..... 84/192, 84/723, 725, 731, 741, 744, DIG. 10, DIG. 24, 84/626, 737, 726; 381/152
See application file for complete search history.

(56) References Cited

U.S. PATENT DOCUMENTS 4,058,045 A 11/1977 Jennings et al.
5,247,129 A * 9/1993 Nozaki et al. ..... 84/615

(Continued)

FOREIGN PATENT DOCUMENTS

EP 0 102 379 1/1987

(Continued)

*Primary Examiner*—Jeffrey Donels
*Assistant Examiner*—Andrew R Millikin
(74) *Attorney, Agent, or Firm*—Salter & Michaelson

(57) ABSTRACT

Disclosed is a pianoforte instrument comprising a musical mechanism with keys. Also provided are strings which are struck via a mechanism when the keys are actuated and are made to vibrate. The vibrations of the strings are transmitted to a sound board. A device is provided for delivering additional oscillating energy into the sound board. Also provided are sensors which directly or indirectly detect actuation of the keys of the musical mechanism. The measured values of the sensors are fed to a sound-amplifying device. The sound-amplifying device is equipped with units which compile data corresponding to a desired characteristic sound in accordance with the measured values of the sensors. The sound amplifying device supplies the sound board with additional oscillation energy via the delivering device according to the determined data.

15 Claims, 12 Drawing Sheets

U.S. PATENT DOCUMENTS 5,262,586 A * 11/1993 Oba et al. ..... 84/723
5,581,623 A * 12/1996 Ishimura et al. ..... 381/396
6,700,047 B2 * 3/2004 Carter, Jr. ..... 84/603

FOREIGN PATENT DOCUMENTS

EP 1 278 180 1/2003
WO WO 83/03022 9/1983
WO WO 90/03025 3/1990
WO WO 00/36586 6/2000

* cited by examiner

PIANOFORTE INSTRUMENT EXHIBITING AN ADDITIONAL DELIVERY OF ENERGY INTO THE SOUND BOARD, AND METHOD FOR INFLUENCING THE SOUND OF A PIANOFORTE INSTRUMENT

TECHNICAL FIELD

The invention relates to an acoustic pianoforte instrument comprising an action with keys, comprising strings which are struck via a mechanism when the keys are actuated and are made to vibrate, comprising a sound board, to which the vibrations of the strings are transmitted, and comprising a device for delivering additional vibration energy into the sound board. It further relates to a method for influencing the sound of a pianoforte instrument comprising an action with keys, comprising strings which are struck via a mechanism when the keys are actuated and are made to vibrate, comprising a sound board, to which the vibrations of the strings are transmitted, and comprising a device for delivering additional vibration energy into the sound board.

BACKGROUND OF THE INVENTION

Pianoforte instruments have been known for centuries. They include, in the first place, pianos and grand pianos. Since the start of the development of acoustic pianoforte instruments approximately 300 years ago, the high degree of interest exhibited by the musically inclined public in high-quality acoustic pianoforte instruments has resulted, through practical intuition and scientifically underpinned development processes, in pianoforte instruments of increasingly high quality. The degree of perfection that has been achieved in the present state of the art may no longer be significantly increased by acoustic/mechanical means.

Pianoforte instruments possess a relatively large number of keys, which, as a result of mechanical influence, cause strings to vibrate. These string vibrations are then in turn transmitted to a sound board. The vibrations of this sound board then produce the sound that the pianist or his audience hears, which sound may be affected by properties of the room in which the pianoforte instrument is located, for example by reverberation or damping.

Additional possibilities for the sound reproduction of pianoforte instruments are proposed, for example, with a high degree of success in the Applicant's WO 90/03025 A1. In this case, an additional delivery of energy into the sound boards of acoustic pianoforte instruments is provided by driver systems. These systems supply the sound board with vibration energy with the aid of a system consisting of magnets and coils.

Other proposals for what are known as digital pianos comprising similar mechanisms are known from EP 0 102 379 B1, WO 83/03022 A1, U.S. Pat. No. 5,247,129 and WO 00/36586 A2.

Systems of this type serve, in particular, to use the sound board of the piano or other pianoforte instrument simultaneously as a kind of the loudspeaker diaphragm for the reproduction of music and voices. On the one hand, this allows a delayed reproduction of the music played on the pianoforte instrument; on the other hand, the pianist may also be provided with artificial accompaniment while he is playing. Alternatively, "muting" may take place during playing in order, for example, to prevent unwanted sound, and thus noise, from being produced during practising. The recorded sound sequences may subsequently be introduced into the sound board, which may be used as a loudspeaker diaphragm for generating a sound that is relatively "faithful to the original".

U.S. Pat. No. 5,262,586 discloses a further application of externally generated vibration energy, which is supplied into the sound board of acoustic pianoforte instruments. In this case, the tones that are acoustically generated by the pianoforte instrument itself are used as the source of tones for generating the vibration energy to be additionally delivered to the sound patterns played. These tones are recorded, for example acoustically or inductively, via sound recorders on or in proximity to the sound board of the instrument. They are then in turn fed back into the sound board as additional energy. This gives rise to a kind of artificial amplification, in a closed system, of the tones that are mechanically generated by means of the keys. Unsatisfactory playing volume, for example in very large rooms, may thus be compensated.

The feedback effect, which can occur when an excessive amount of energy is supplied, poses a particular problem, as the sound board, which is made to resonate additionally, can of course also affect the sound recorders.

OBJECTS OF THE INVENTION

The object of the invention is accordingly to propose pianoforte instruments having still further possibilities. A further object consists in proposing methods for influencing the sound of a pianoforte instrument having additional possibilities.

The first object is achieved in that sensors, which directly or indirectly detect actuation of the keys of the action, are provided, in that a sound-augmenting device, to which the measured values of the sensors are supplied, is provided, in that the sound-augmenting device is equipped with units which compile data corresponding to a desired characteristic sound as a function of the measured values of the sensors, and in that the sound-augmenting device supplies the sound board with additional vibration energy, corresponding to the data obtained, via the delivering device.

The second object is achieved in that actuation of the keys of the action is directly or indirectly, detected by means of sensors, in that the measured values of the sensors are supplied to a sound-augmenting device, in that units which compile data corresponding to a desired characteristic sound as a function of the measured values of the sensors are provided, and in that the sound-augmenting device supplies the sound board with additional vibration energy, corresponding to the data obtained, via the delivering device.

THE INVENTION

The equipping according to the invention of keyboard instruments, in particular of pianoforte instruments, with acoustic sound generation allows both extension and/or amplification of the sound spectra provided of each individual overall tone and variation of individual, or a plurality of selected, partial tones from the sound spectra of the individual tones, and thus also allows variation of the sound phases of individual tones. This is accompanied, in each case, by augmented resonance properties of the harmonically resonant tones/partial tones of other tone ranges of the instrument, and also with amplified and/or prolonged natural vibrations of the vibrating acoustic strings of the relevant tone. This allows significant variations in the sound phases of individual tones, of a large number or of all tones, and thus the prolongation, amplification, variation and/or augmentation of the sound patterns and of the characteristic sound of the instrument, indeed selectively in the case of individual tones, complex tone sequences, in selected pitches or over the entire pitch range of the instrument equipped according to the invention.

The additional vibration energy is supplied almost in real time, without delay.

The sound augmentation is brought about by the additional delivery of externally generated vibration energy, which is preferably supplied to the sound board via sound board drivers. The additional vibration energy is used to counteract, to a freely determinable degree, the consumption of the energy absorbed by the vibrating acoustic strings that is conventional, according to the prior art, in the sound board, which vibrates in the manner of a diaphragm. The additional vibration energy therefore accumulates in the sound board, which vibrates in the manner of a diaphragm, with the vibration energy that is acoustically generated by the vibrating acoustic strings, and becomes mixed in the sound board to form the sound patterns (sound spectra) thus extended of the individual tones, and consequently to form extended sound patterns.

Unlike in U.S. Pat. No. 5,262,586, for example, the sound that has already been generated on the vibrating sound board, for example, is not gauged by the sensors; rather, the "cause" of the sound, i.e. the actuation of the piano key, is gauged, for example by observing the hammer head unit and the behaviour thereof. However, this allows much earlier intervention, i.e. during the sound-formation phase, the origin of the vibrations of the sound board. Undesirable feedback effects are thus prevented, and quite different sound modifications are of course facilitated, as a result of the system. According to the invention, it is possible to operate almost in "real time".

The present invention does not derive the information or input data from secondary sources. In the past, a person skilled in the art has of course assumed that a vibrating string, a vibrating sound board, etc. is precisely the sound that he should aim to have reproduced in an isolation and subsequent use of the information. A person skilled in the art wishes to reproduce precisely the original sound of the vibrating string. In the past, the vibrating string was, from his perspective, the primary source. At first glance, this would appear to be logical and consistent. The invention in the present application has for the first time recognised that this is wrong and used the true primary source for information: the movement of the keys.

It is not the actual sound in question, but rather the basis, in other words the origin, of the sound that is used, i.e. by sensors that gauge the speed or position of the keys, and the information is subsequently processed via these sensors. This results in a completely differently arranged basic treatment of the "causes" of the music and also of the behaviour of the overall equipment. Thus, not only may sounds be reproduced or recreated at relatively high volume, perhaps by means of simple amplification, but rather the desires and will of the pianist may be utilised quite differently, precisely in accordance with the pianist's wishes, as he actuates the keys, in order to generate a musical sound that, according to an annex to U.S. Pat. No. 5,262,586, is supposedly quite impossible. The measures according to the invention and disclosed in the application allow, for example, information regarding the location and the hall of an auditorium to be taken into account during reproduction of the sound or use of the data, which was not even provided during the original recording.

Unlike in the prior art, the individual tone or the individual key is also taken into account, wherein each individual tone or key may be treated differentially. After all, in U.S. Pat. No. 5,262,586, the entire sound impression that is created is taken as the basis, without differentiation as to its origin, for modifications that only then take place.

The intensity of the impact of the hammer heads on the acoustic strings determines the degree to which energy is transmitted to the acoustic strings, and is thus critical to the vibration behaviour of the acoustic strings.

The degree to which energy is transmitted may broadly be influenced by the nature of the striking of the keys, the coordination of the lever systems (adjustment) with one another and the characteristics of the hammer heads (weight, size, shape, material and intonation). In other words:

Extreme Pianissimo (ppp) is a result of the minimum possible acceleration of the hammer heads on their path to the acoustic strings, so when the hammer heads strike the acoustic strings, they transmit only a minimum degree of energy to the acoustic strings. This minimum possible energy transmission causes minimum vibration of the acoustic strings, a minimum amount of vibration energy thus entering the sound board via the acoustic bridges, so said sound board experiences only minimum vibration, as a result of which extremely quiet tones, tone sequences or sound patterns may be heard.

Extreme Fortissimo (fff) is a result of the maximum possible acceleration of the hammer heads on their path to the acoustic strings, so when the hammer heads strike the acoustic strings, they transmit a maximum degree of energy to the acoustic strings. This maximum possible energy transmission causes maximum possible vibration of the acoustic strings, a maximum amount of vibration energy thus entering the sound board via the acoustic bridges, so said sound board experiences its maximum possible vibration, as a result of which extremely loud tones, tone sequences or sound patterns may be heard.

At all volume levels, the shape and the weight of the hammer heads, the quality of the hammer head felts, the tension within the felt layers and the nature of the intonation are significant with respect to the partial tone structure of individual tones, this partial tone structure forming in the initial milliseconds immediately after the hammer head strikes the acoustic strings, and thus being of crucial importance for the sound-formation phase.

Observing the movement of the hammer head unit using the sensors is thus highly advantageous.

Externally stored, preferably digital, tone samples, which may be supplied to the sound board in any mixture and in any form of energy, are preferably used as a source of the additionally supplied energy, so each individual tone may be configured in its partial tone spectrum and in its individual sound phases. At the same time, the use of the tone samples as an external energy source prevents any feedback effect, so the degree of additional vibration energy that may be supplied into the sound board is not bound to the limits of a feedback effect, but rather is limited merely by the mechanical stability of the vibrating components of the sound element, in particular of the sound board. The term "energy source" is to be understood, in this case, figuratively, not literally: the memory comprising the tone samples contains the vibration energy data, not the energy itself, which is coupled, for example, via an amplifier.

The invention allows a musician, specifically a pianist, to extend still further his influence, on the music that he plays: in addition to the piece of music and his interpretation thereof, he may "establish" with respect to almost any sound whether he is playing in a large or small room, what type of piano he is using, how the piano has been tuned and what particular emphases he is able to create, in a manner varying from composition to composition. The volume and speed are also no longer restricted unnecessarily by the instrument.

Unlike in the case of the mutable pianos known from WO 90/03035 A, for example, exhibiting a comparatively delayed reproduction that is relatively faithful to the original, there is possible a purposeful and, in particular, almost non-delayed sound optimisation and adaptation to specific marginal conditions, for example compensation of unfavourable spatial and hall circumstances, simulation of a different piano model, or a highly specifically desired amplification or reduction of only the 500 Hz vibration of a highly specific tone, for example, without the 500 Hz vibrations of other tones also being influenced.

The design according to the invention may also be retrofitted to existing pianoforte instruments—a significant advantage, particularly in the case of valuable specimens.

BRIEF DESCRIPTION OF THE DRAWINGS

The fundamental principles of the invention and some embodiments will be described below in greater detail with reference to the drawings, in which.

DETAILED DESCRIPTION OF THE PREFERRED EMBODIMENT

Figure 1:
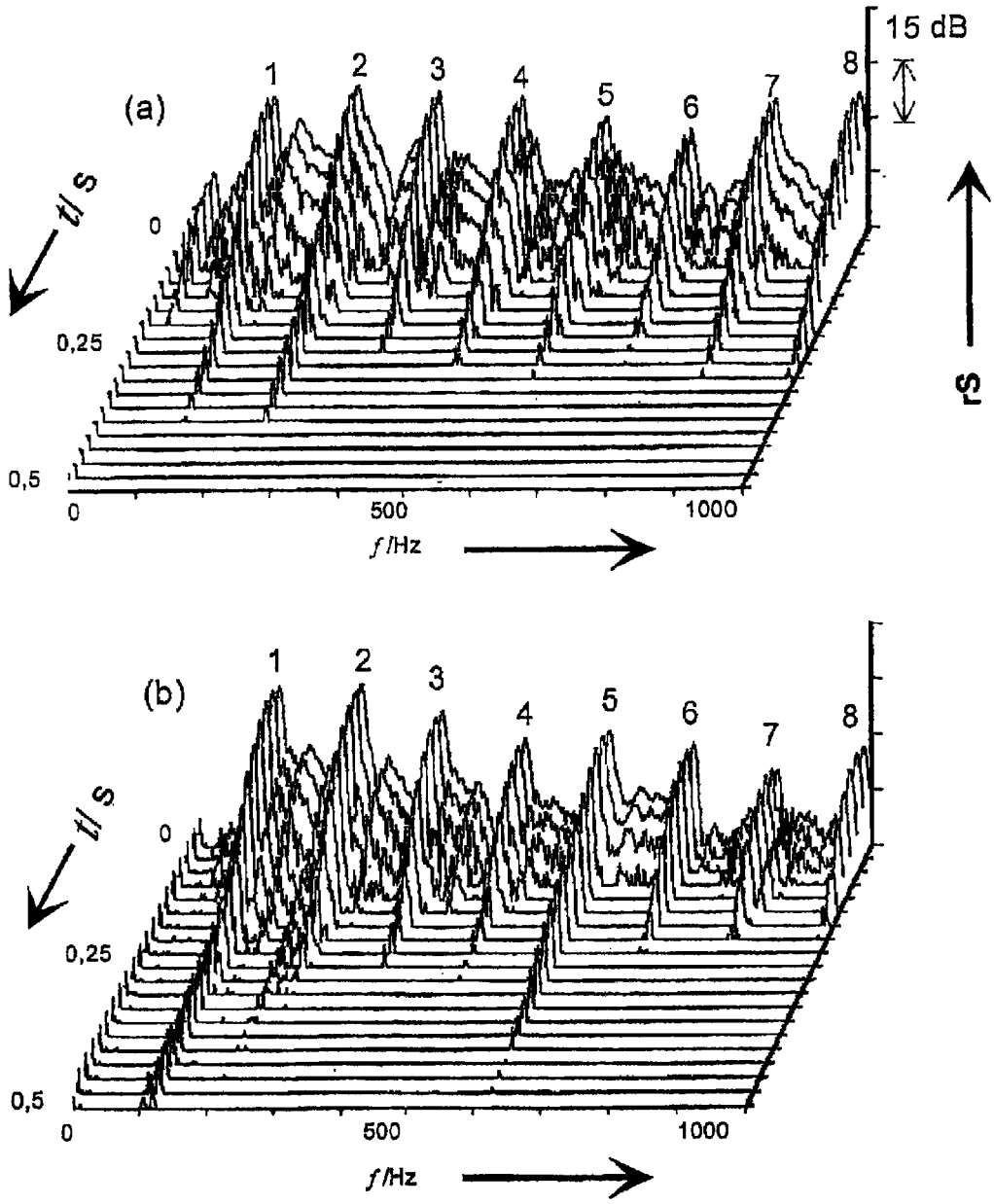
FIG. 1 is a typical waveform of an acoustically generated primary tone of a musical instrument.

FIG. 1 is the typical waveform of an acoustically generated primary tone H of a grand piano (top) or a piano (bottom). The primary tone H has a large number of what are known as harmonic or partial tones. These harmonic or partial tones of each primary tone form the respective sound spectrum or partial tone spectrum of the corresponding tone.

The tones of good acoustic pianoforte instruments may comprise a large number of partial tones. It is assumed that in the case of good acoustic pianoforte instruments, up to approximately 13 audible partial tones are constructed for the human ear.

FIG. 1 shows eight of these partial tones with their waveforms, in the indicated three-dimensional form in their time characteristic.

The spectrogram shows, from left to right, the number of partial tones selected for this illustration, with the frequency f thereof in hertz, and, from top to bottom, the characteristic of the dying-out phases of the illustrated partial tones, i.e. the time axis t in seconds. The relative sound pressure level in dB is plotted protruding upward from the time axis. The sound-formation phase has in this case been omitted for the sake of clarity. The vibration characteristic of the individual partial tones is subject to constant variations. It varies continuously in its composition and the intensity of the individual partial tones relative to one another, thus producing the typical piano sound. In the case of other musical instruments, the same primary tone H therefore sounds different to the human ear, so the listener may easily distinguish a primary tone H of a piano from a primary tone H of a guitar. The trained ear of a musician, a music lover and a person skilled in the art can also distinguish the typical sound of a single primary tone played on various piano models, as the typical time sequence of the individual partial tones also varies, to a greater or lesser degree, from piano to piano.

The partial tone structure, with its waveforms, changes continuously, in varying forms, during the sound-formation phase and the dying-out phase. It is also dependent on the pianist's manner of playing (loud, quiet, staccato, legato, with/without damper pedal, with/without tone sustainment, etc.).

The aforementioned variations in the time characteristic of the individual partial tones and the resulting different sound of the composition pervade the entire time period, from the moment of impact of a hammer head on the acoustic strings, during the sound-formation phase (not shown in the spectrogram) and for the duration (shown in the spectrogram) of the entire dying-out phase, up to the final stilling of the acoustic strings. The variations are also in constantly changing interaction with the other partial tones of the same primary tone, and also interact with the primary and partial tones of other tones within the overall pitch range of the instrument, which tones are harmonically related to the struck tone and the partial tones thereof.

Figure 2:
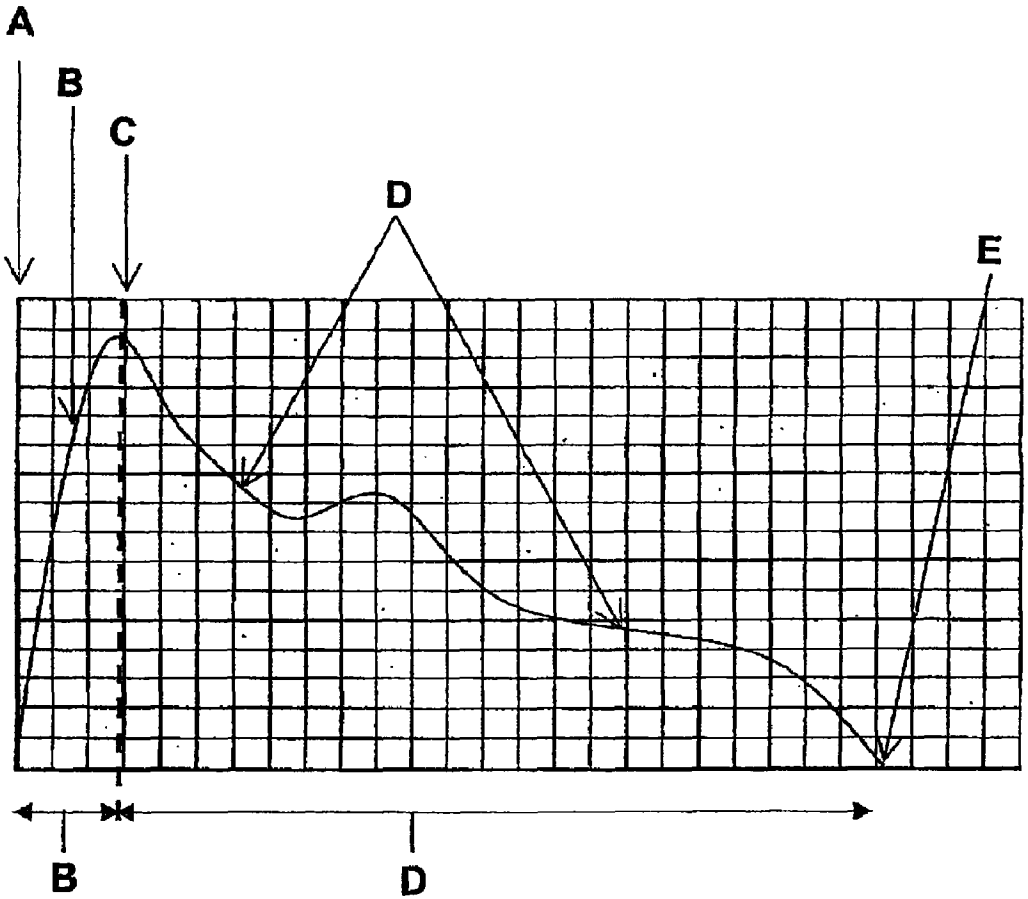
FIG. 2 is a waveform showing details of the sound-formation phase and the dying-out phase of a tone.

FIG. 2 shows the audible sound characteristic of a selected tone without the delivery of additional vibration energy, i.e. the characteristic without the application of the invention. The tone is generally reproduced without the partial tone spectrum contained therein being illustrated. Time is plotted to the right; the intensity or the sound pressure level, once more, toward the top.

As may clearly be seen in FIG. 2, the sound-formation phase B starts at the moment A of impact of a hammer head on the acoustic strings, and the vibrations of the acoustic strings thereby initiated, and ends at moment C, at which the acoustic strings have converted the impact energy into the maximum vibration energy and the dying-out phase D begins.

During the sound-formation phase (also known as the build-up period), each individual acoustic string starts to vibrate at its primary tone and the associated partial tones. The dying-out phase follows on continuously from the end of the sound-formation phase and ends at moment E, when the vibration energy has been absorbed in the acoustic strings.

The illustration also shows, inter alia, that the characteristic of the dying-out phase also by no means merely declines; rather, the audible sound characteristic certainly exhibits inflection points and peaks. After all, it is precisely these effects that also influence the sound impression that a specific tone creates in the case of a specific musical instrument. The illustrated characteristics have been selected in this case purely by way of example, i.e. they will certainly differ in the case of various tones.

Figure 3:
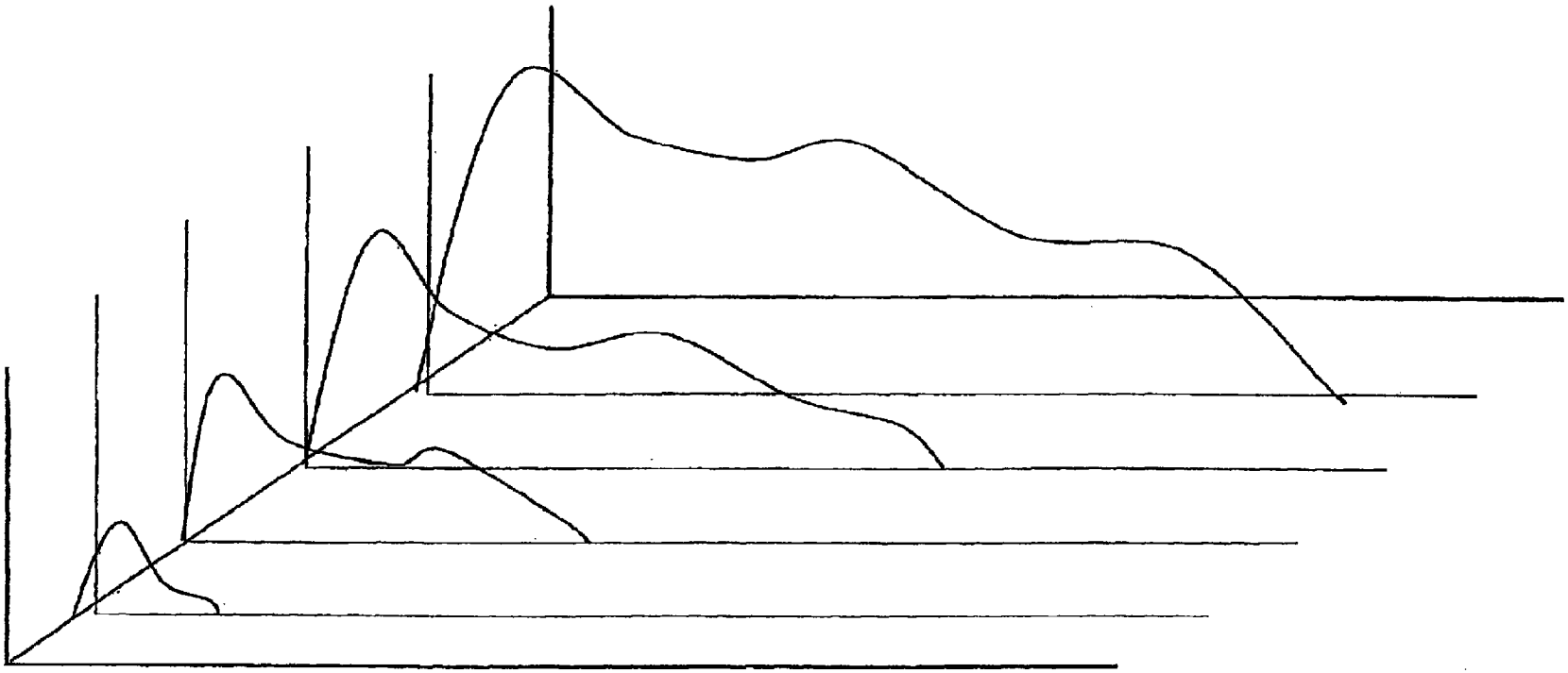
FIG. 3 is a schematic illustration of the phases from FIG. 2, showing four of the audible partial tones.

FIG. 3 is a substantially simplified, schematic illustration of the sound-formation phases and dying-out phases, taking the example of only four of the above-mentioned up to 13 audible partial tones. FIG. 3 shall be considered hereinafter as a reference diagram for the variations that occur under the exertion of a corresponding influence.

The following figures show that the inventive design allows various forms of sound variation and influence. The illustrations are presented in an almost three-dimensional form. However, in each case, time is plotted from left to right, the intensity of a specific partial tone from bottom to top, and four selected partial tones are plotted in succession from front to back. The result is therefore a simplified illustration of the partial tone spectrum of a tone. The audible sound characteristic of the four-part tones is illustrated in each case. The solid line L illustrates the sound generated by the vibrating acoustic strings of a pianoforte instrument, without the delivery of additional vibration energy. The thick-dotted line M indicates the sound characteristic of the same partial tones if, in addition to the sound characteristic generated by the vibrating acoustic strings, a further delivery of additional vibration energy takes place, wherein the nature and form of this delivery will be described below in greater detail in the remaining parts of the description.

The thin-dotted line N takes account of the fact that an amplified resonant vibration of the acoustic strings themselves now also takes place.

Figure 4:
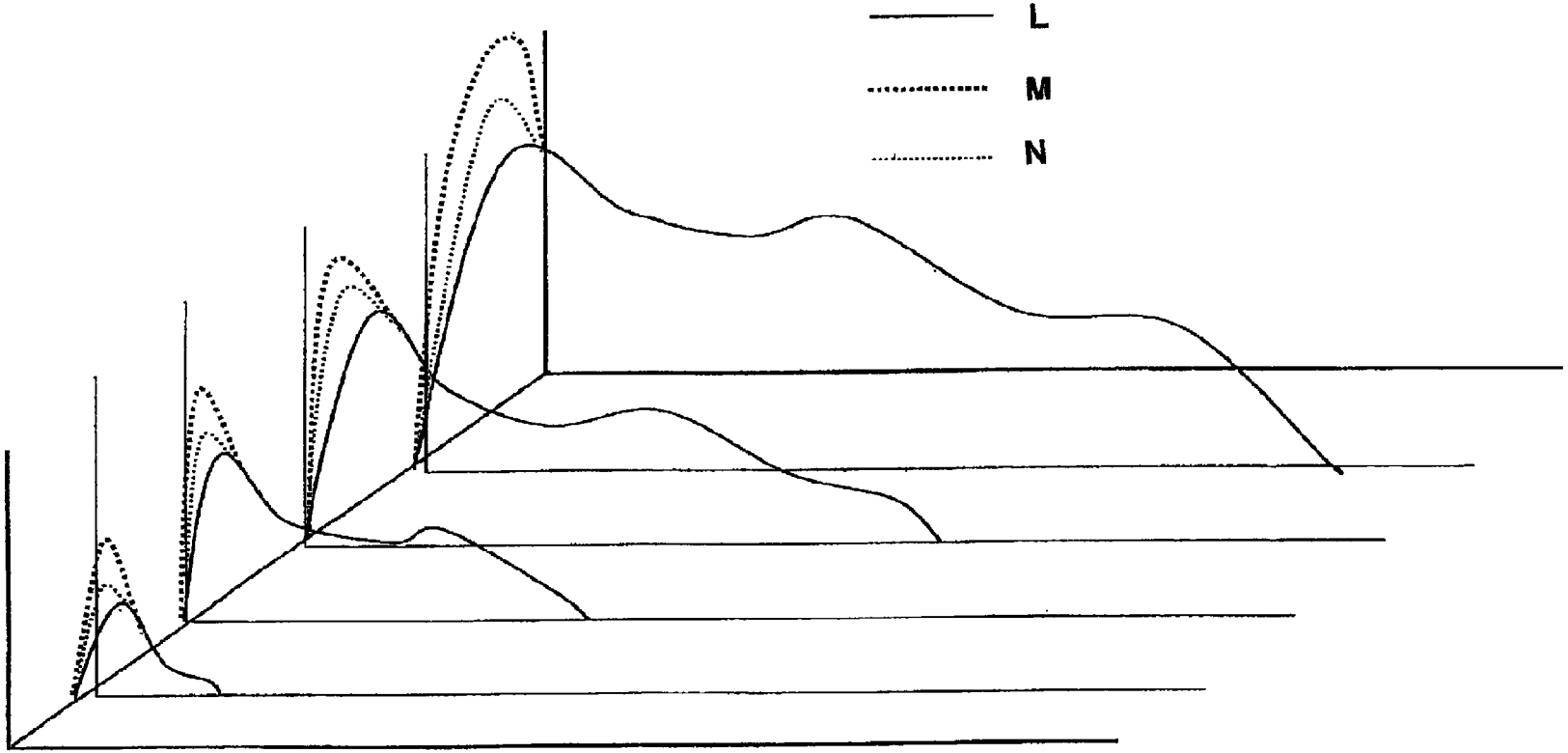
FIG. 4 is the schematic illustration from FIG. 3, showing an amplification of the sound-formation phase.

FIG. 4 shows how, in the sound-formation phase, vibration energy is additionally delivered, thus causing amplification of the entire tone over all of the partial tones. If this alteration is undertaken, the main change noticed by the listener will be the impression with respect to hardness and volume of the strike.

Figure 5:
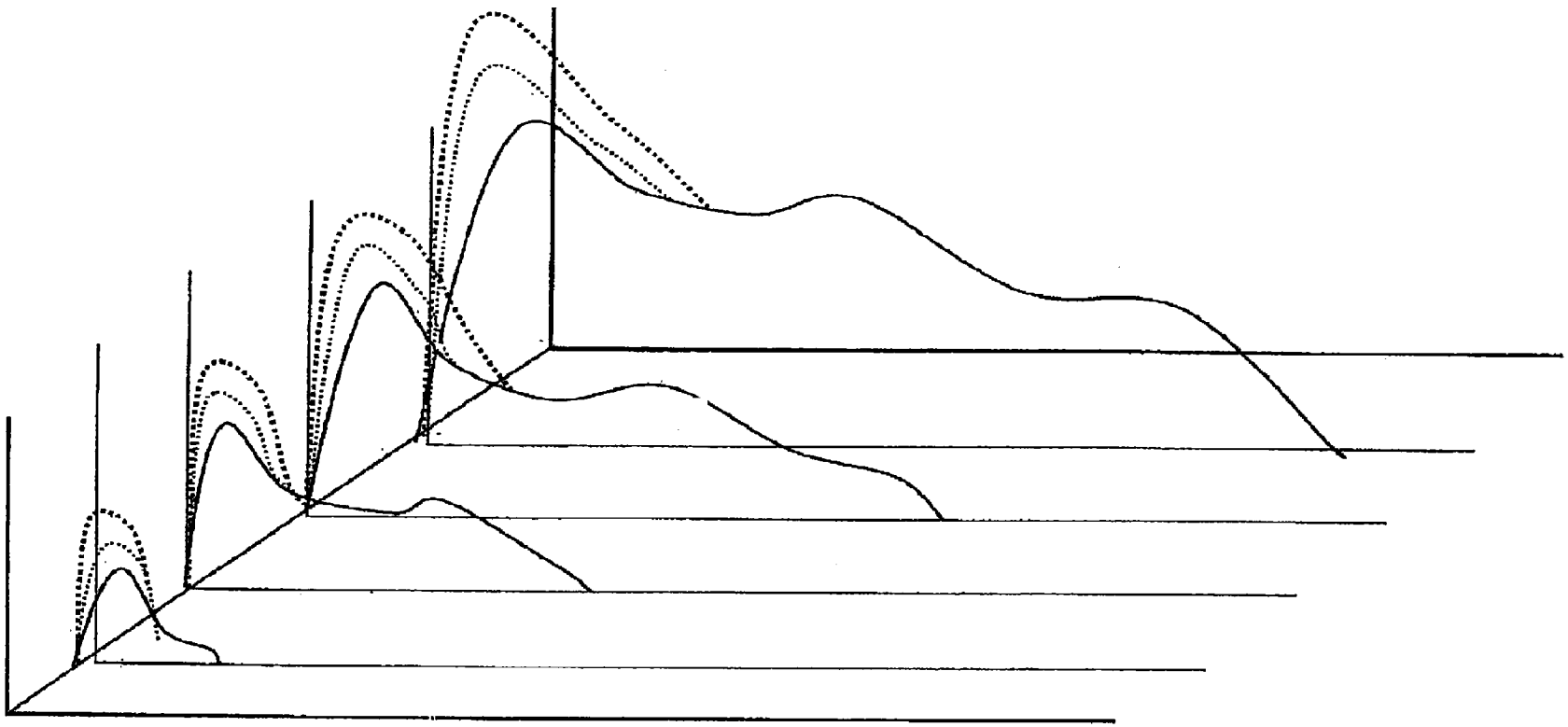
FIG. 5 is the schematic illustration from FIG. 3, showing an amplification and prolongation of the sound-formation phase.

FIG. 5 shows, in a similar form, that the sound-formation phase may be both amplified and prolonged in that vibration energy is in this case delivered.

Figure 6:
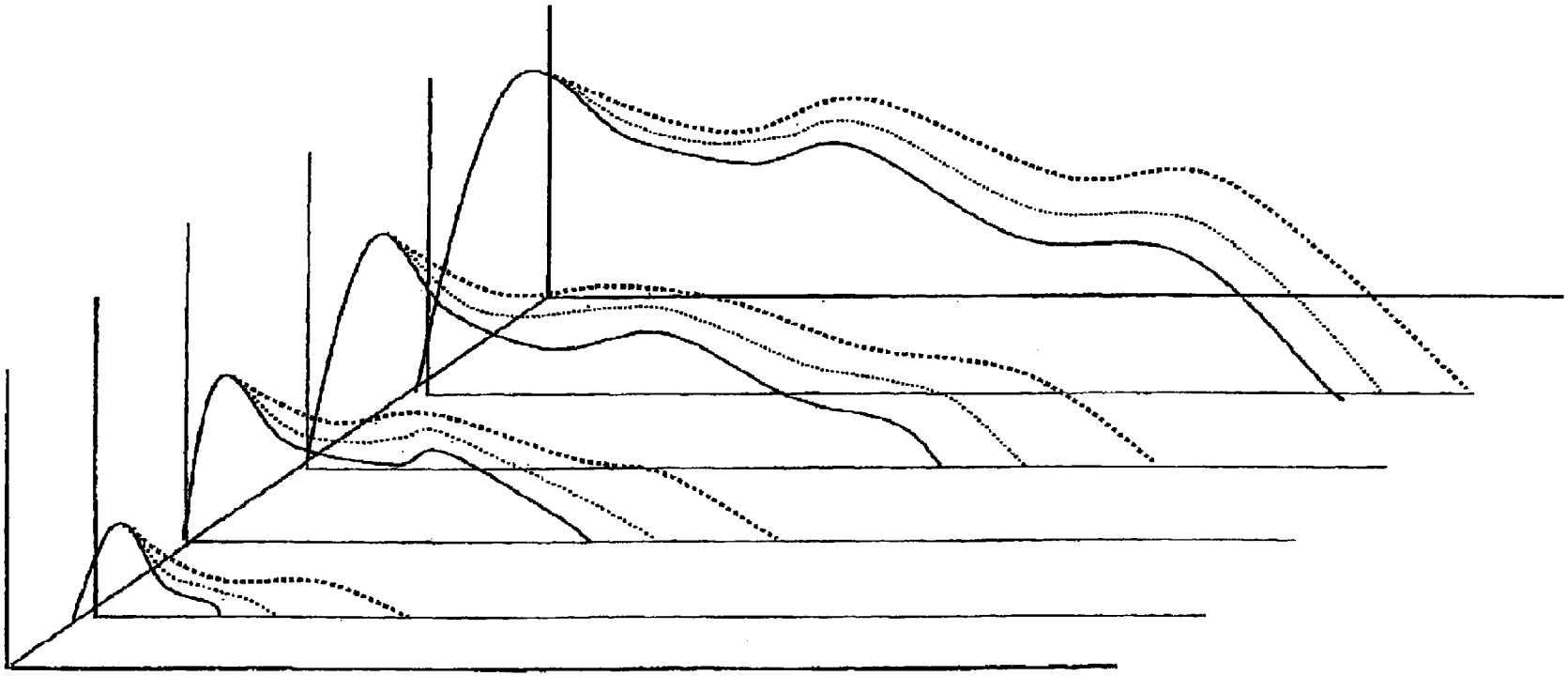
FIG. 6 is the schematic illustration from FIG. 3, showing a prolongation and amplification of the dying-out phase.

FIG. 6 shows an unaltered sound-formation phase, although the dying-out phase has been prolonged and amplified, once more for the entire tone. The duration of the tone has been increased.

Figure 7:
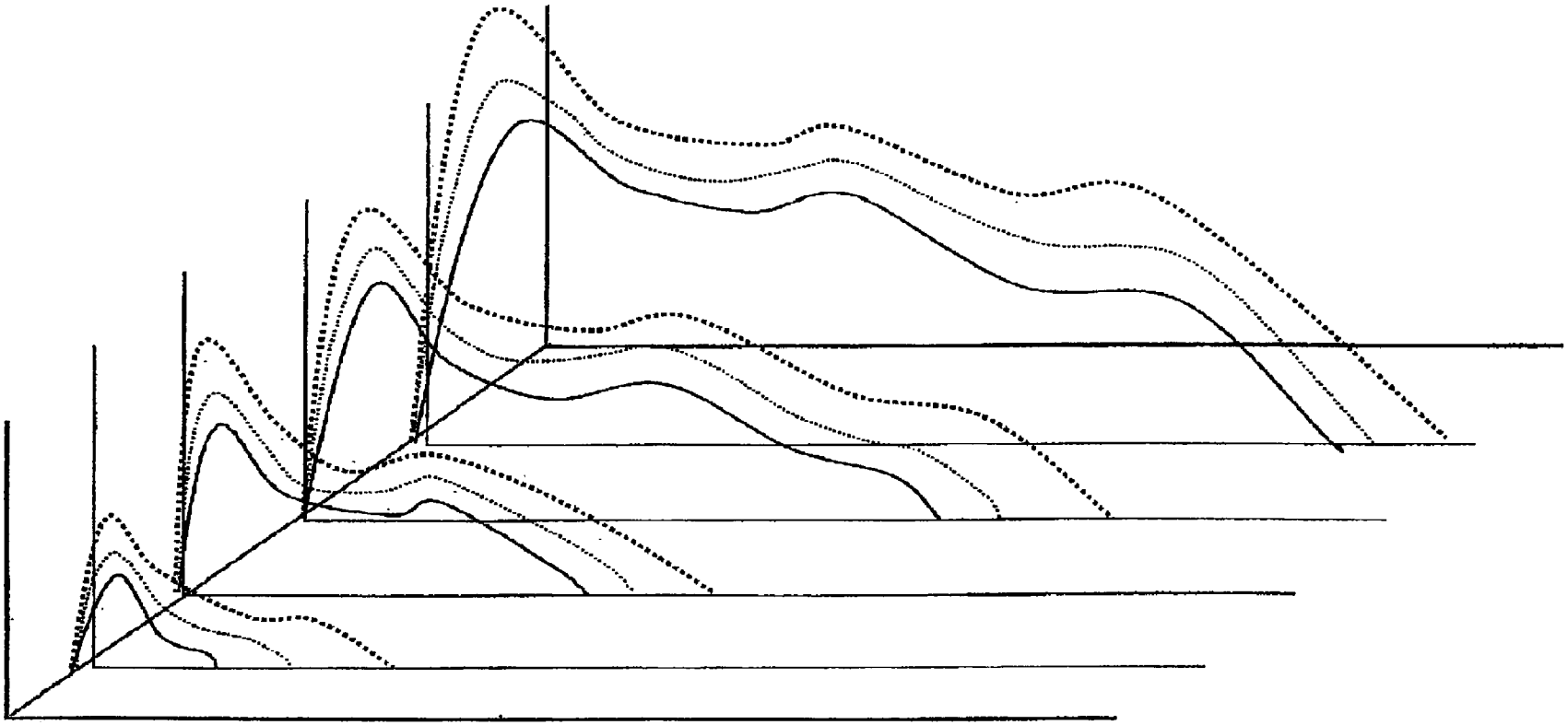
FIG. 7 is the schematic illustration from FIG. 3, showing a prolongation and amplification of both the sound-formation phase and the dying-out phase.

FIG. 7 shows a prolongation and amplification of both the sound-formation phase and the dying-out phase, as a result of which the two effects now complement each other.

Figure 8:
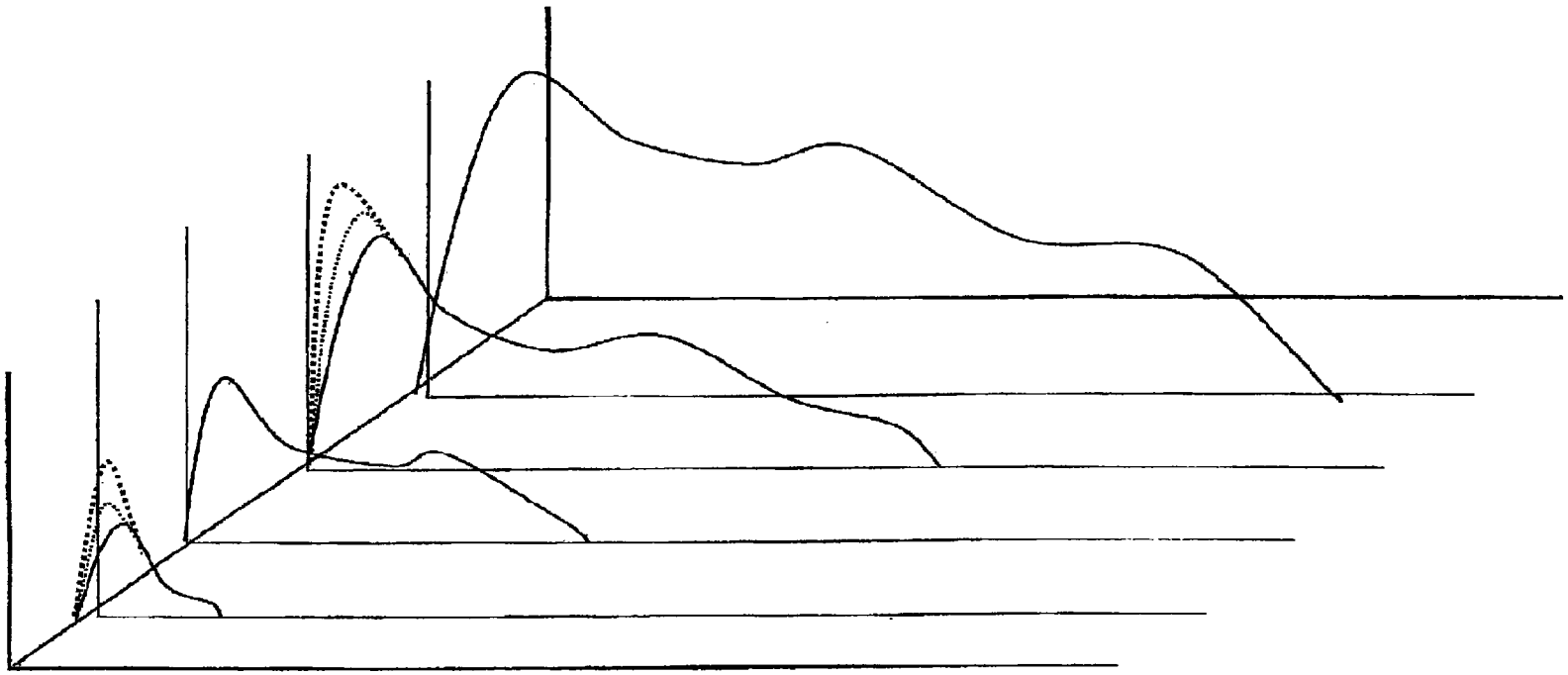
FIG. 8 is the schematic illustration from FIG. 3, showing a purposeful amplification of the sound-formation phase only in the case of selected partial tones.

FIG. 8 and the following illustrations show that the characteristic sound of individual tones or whole pitches is purposefully varied and enriched. This takes place by means of a purposeful supply of vibration energy based on individual, or else a plurality of selected, partial tones of the sounding tone.

In the case of FIG. 8, this takes place by means of a purposeful amplification of two partial tones in the sound-formation phase.

Figure 9:
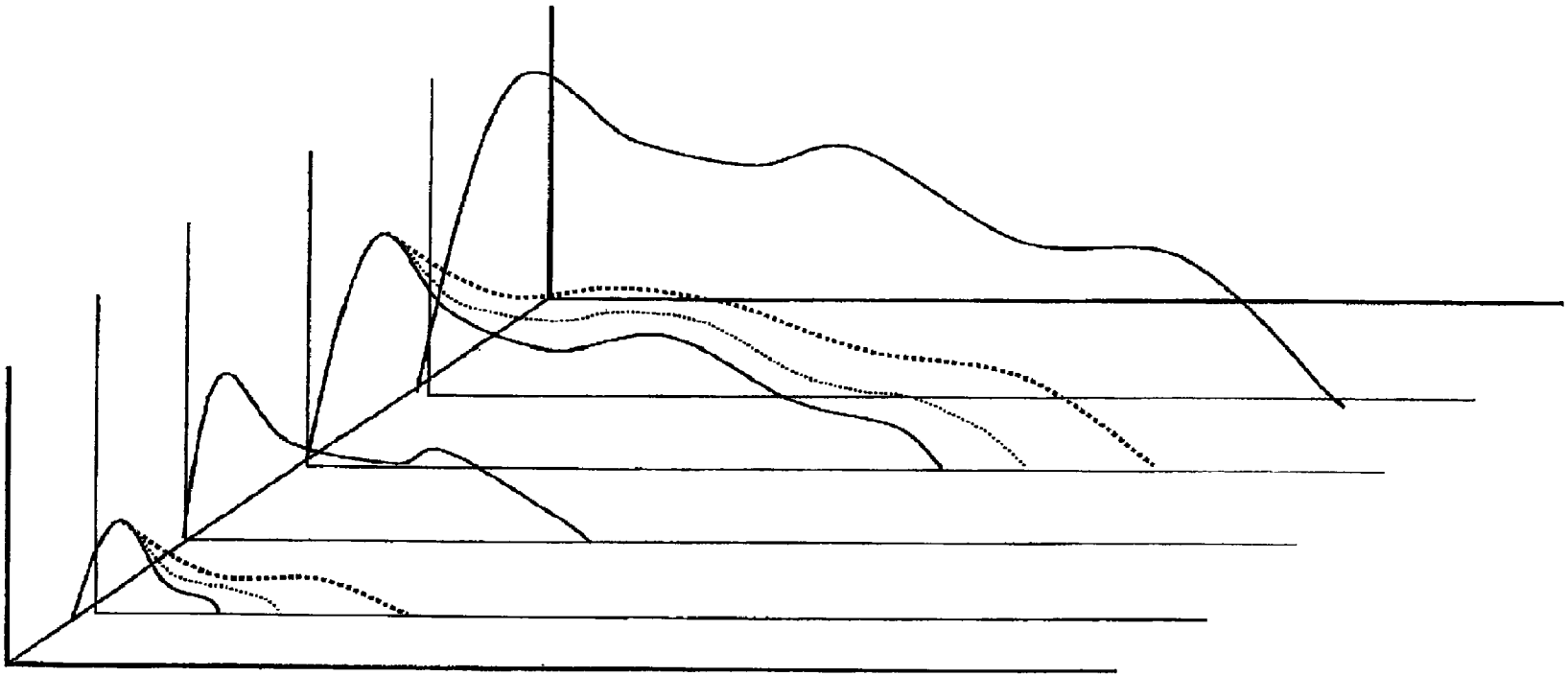
FIG. 9 is the schematic illustration from FIG. 3, showing a purposeful prolongation and amplification of the dying-out phase only in the case of selected partial tones.

In FIG. 9, this takes place by means of a purposeful prolongation and amplification of individual partial tones in the dying-out phase.

Figure 10:
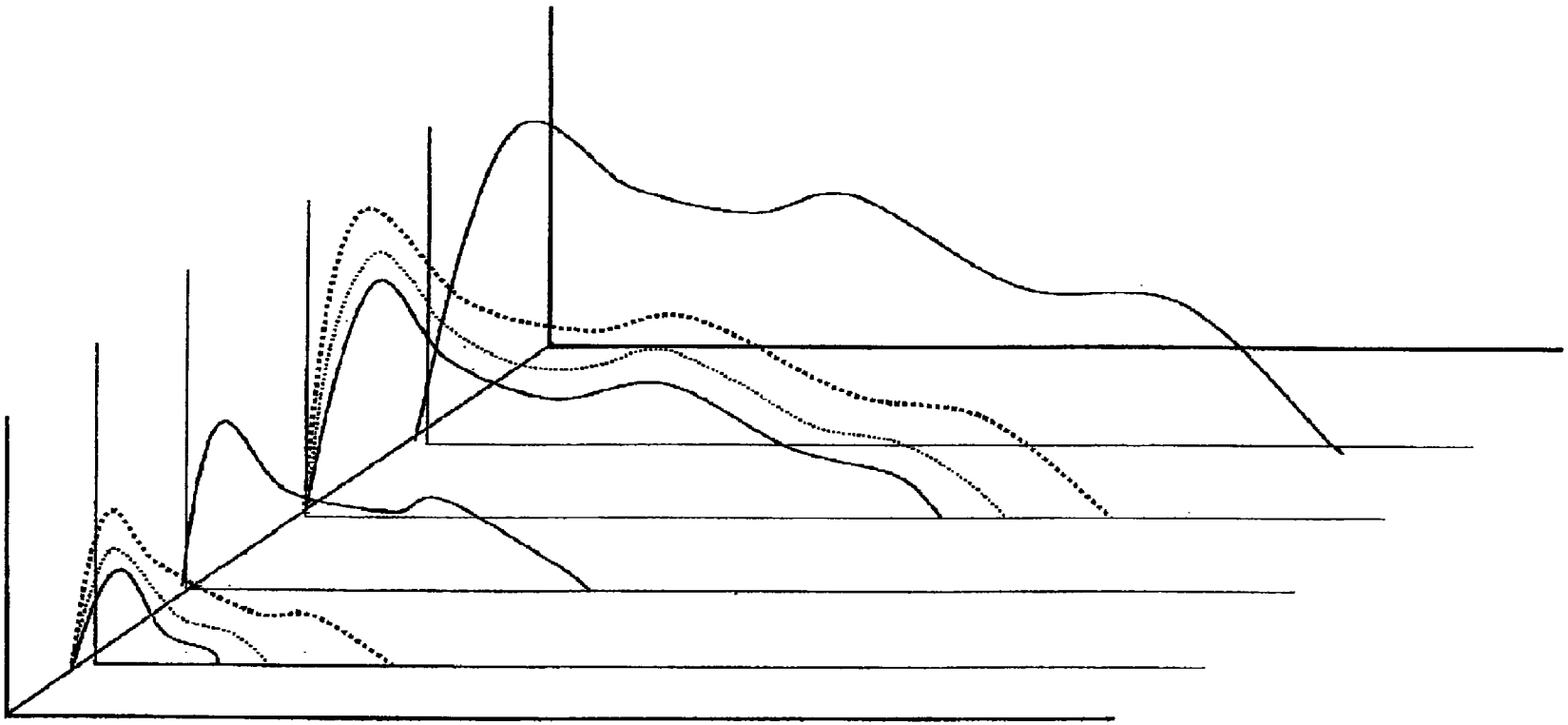
FIG. 10 is the schematic illustration from FIG. 3, showing a prolongation and amplification of the sound-formation phase and dying-out phase only in the case of selected partial tones.

In FIG. 10, this takes place by means of a prolongation and amplification of individual partial tones in both the sound-formation phase and the dying-out phase.

Figure 11:
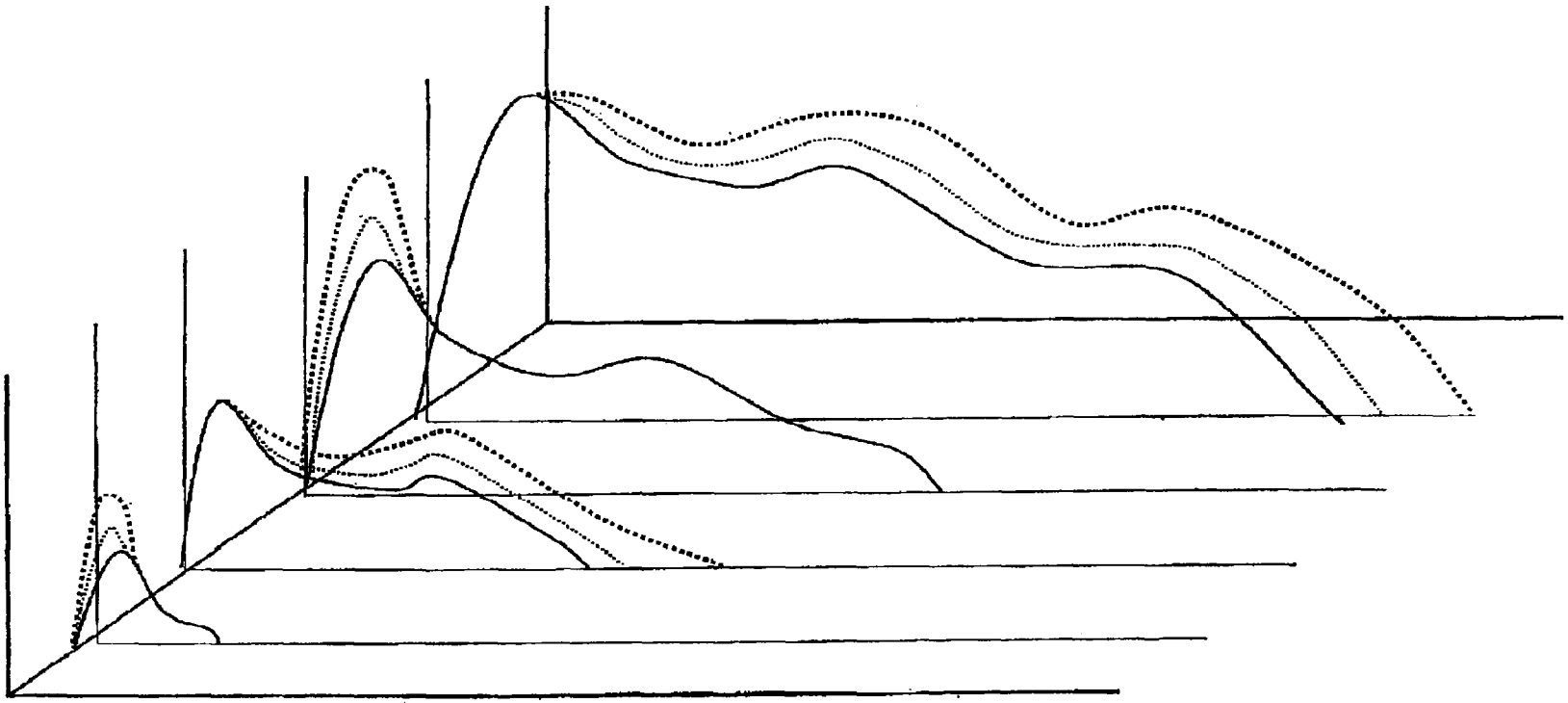
FIG. 11 is the schematic illustration from FIG. 3, showing a different prolongation and amplification of the sound-formation phase and dying-out phase of different partial tones.

Finally, FIG. 11 shows a prolongation and amplification of different partial tones, in different forms, both in the sound-formation phase and in the dying-out phase.

As a result of the possibilities, illustrated in FIG. 4 to 11 and correspondingly described, for influencing the audible sound phases, the sound patterns of individual tones, or optionally also selected partial tones of individual tones, may thus optionally be extended and/or amplified and generally altered in respectively variable forms.

It is thus optionally possible purposefully to alter and to influence the overall sound of the instrument or else only the sound patterns and the characteristic sounds of individual tones, tone sequences or selected pitches. This provides hitherto unknown possibilities for sound design. The following examples of the sound-forming function of the instruments are by no means exhaustive, and further possible applications exist:

a) An application to various forms of musical expression, originating, for example, from different musical periods, is possible.

b) An adaptation to different acoustic spatial circumstances in which the pianoforte instrument is located, is possible. Small and large, empty and full halls may thus be considered, according to the pianist's choices and preferences, and the resulting sound deficits or sound variations compensated. Reverberation times or acoustic characteristics of specific rooms may also be compensated or else simulated elsewhere, as desired.

c) The particular expectations held by pianists and requirements placed by piano-playing on the sound properties of the instrument or the sound effect thereof in the room may be individually adjusted.

d) Account may be taken, substantially more effectively than was the case in the past, of musically distinct requirements and demands placed on the instrument. Pianoforte instruments may thus be used for entirely different purposes, for example for song accompaniment, for chamber music or else as a solo instrument, while on the other hand emphasizing or possibly diminishing the pianoforte instrument, which may also vary greatly at specific tones, is highly desirable in specific orchestra situations.

Figure 12:
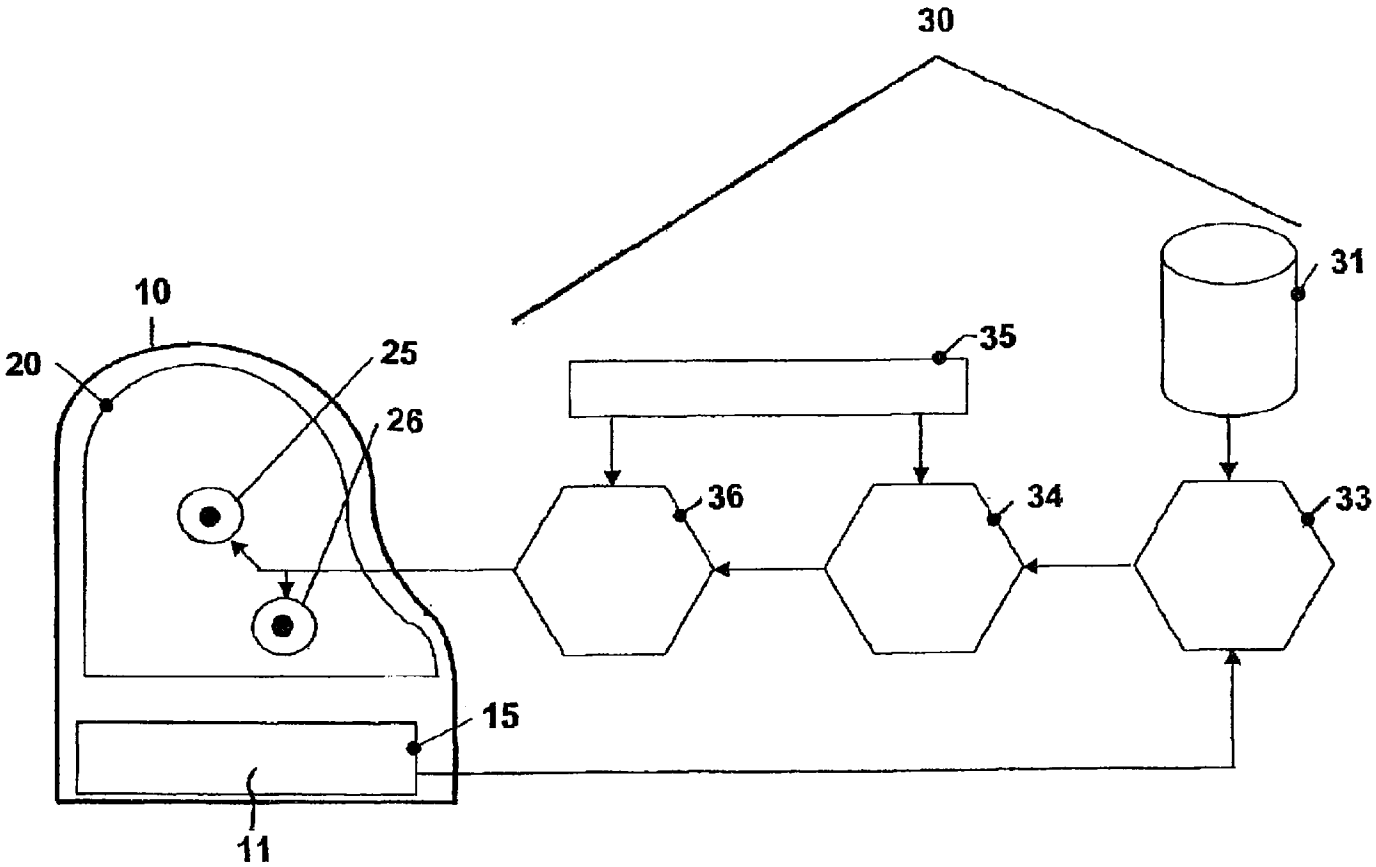
FIG. 12 is a schematic illustration of the technical construction of an embodiment of the arrangement according to the invention.

FIG. 12 shows the components that are contained in one embodiment of an arrangement according to the invention of a pianoforte instrument.

A pianoforte instrument 10 has an action 11 comprising a series of keys (not shown individually in FIG. 12). The keys of the action 11 act on strings by means of a lever construction and a hammer head unit, and the strings in turn cause a sound board 20 to vibrate. The sound board 20 is a surface that is tensioned in the manner of a diaphragm and is stably mounted all the way round on or in the pianoforte instrument 10.

According to the invention, the keys of the action 11 are equipped with sensors 15. These sensors do not necessarily have to be arranged on the key itself. The movements of individual lever elements in the action 11 of the pianoforte instrument may also be recorded. The sensors 15 may be arranged below, above or behind the keys, within, in front of or behind the lever system of the action 11, above, below or behind the hammer head unit, or elsewhere. The sensors 15 may be mechanical, optical, inductive sensor systems, or sensor, systems acting magnetically or otherwise, for recording the corresponding movements within the action 11.

The sensors 15 record, for example, the acceleration of the lever elements of the action 11 that are selected for measurement. The strike intensity or the impulse of the hammer heads on the acoustic strings, and thus the sound intensity, i.e. whether the player is currently playing pianissimo or fortissimo or at a sound intensity therebetween, may then be determined from the measured accelerations in further devices that will be discussed below. In other embodiments, sensors 15 for the position, the speed or other data may also be used.

The sensors 15 are able individually to register, for each individual tone, the mechanical movements of one or more selected parts within the action 11. They then supply information, which is preferably in MIDI (musical instrument digital interface) format. This information contains data regarding, for example, the start of the downward movement of a key and the end of the downward movement of a key. The tone sustainment period, i.e. the time for which the pianist holds down the key and/or depresses the damping pedal or the tone sustainment pedal, may also be provided as information. Information regarding the upward movement of the key or regarding a key that has returned to its rest position may also be transmitted.

This MIDI data, which is obtained by the sensors 15 and generated in a corresponding format, is then transmitted to a device 30. This device 30 contains, inter alia, a tone control device 33. This device is also able to retrieve data from a tone sample memory. In each case, those tones, or partial tones of a tone, that correspond in pitch to the respectively played tone are obtained from a memory 31 as a function of the transmitted data from the sensors 15. This memory 31 therefore acts as an external data source that will form the basis for the supply of additional vibration energy into the sound board 20.

This data may include frequencies stored individually for each tone, characteristic partial tones, and parameters of the sound-formation phase and dying-out phase.

From the data from the sensors 15 and data pertaining thereto obtained from the memory 31, regarding the volume and tone length of the respectively played tone, the tone control device 33 provides a further tone modification device 34 with initial values.

This tone modification device 34 may optionally then purposefully amplify, raise or prolong the structure, the construction and the composition of the partial tone spectrum of each individual tone. The data received from the tone control device 33 are for this purpose accordingly prolonged, supplemented, amplified and otherwise altered. This allows individual configuration, augmentation and formation, tone for tone, in accordance with FIG. 4 to 11 and the associated parts of the description.

The correspondingly selectively chosen tone supplementation parameters therefore allow, for each individual tone, with respect to its overall partial tone spectrum or partial tones selected therefrom, in any composition during the sound-formation phase, during the dying-out phase and/or during both phases, substantial influencing and enrichment, by means of addition, amplification and prolongation, of the sound formation taking place in the sound board 20.

A control module 35 is also provided in the illustrated embodiment. This control module 35 may comprise defaults, presets, regulators and/or screen-controlled software, which may be operated or influenced, during playing, by the pianist or else by other persons involved in the performance. It is therefore possible, for example, to influence a particular piece during a musical performance in one manner, but to influence a subsequent piece quite differently. Account may therefore be taken of the very different characteristics of the individual pieces of music. Compositions from the baroque period, for example, may therefore be performed in an entirely different partial tone composition, i.e. with a very different sound pattern, to pieces that were composed in the 20th century, for example, with different sound conceptions.

Alterations may also be made, if desired, during the individual piece of music in order, for example, to influence various passages of a piece of music in a different manner. Thus, for example, the impression may be created, for specific moments within a piece of music, that the performance is taking place in a cathedral, in which, for example, corresponding reverberation effects are artificially produced by the extension of partial tones, although this does not occur for the remainder of the piece of music.

An amplifier unit 36 then amplifies the signals received from the tone modification device 34 and the control module 35. The extent of the amplification of the signals may also be determined via the control module 35, optionally via defaults, presets, regulators and/or screen-oriented control software.

Finally, the amplifier unit 36 provides the energy required to allow the modified data to be delivered from the preceding devices into the sound board 20 in an energy-efficient manner.

The additional vibration energy is delivered into the sound board 20 via driver systems 25, 26 acting electromagnetically. Depending on the size of the musical instruments and the volume of energy to be additionally supplied, one or more driver systems 25, 26 of this type are optionally installed in a musical instrument or in its sound board 20.

The driver systems 25, 26 comprise coils fastened to the sound board 20, specific magnetic systems, which may freely be three-dimensionally adjusted in the room, and driver magnets. The driver systems 25, 26 advantageously comprise coils that have a minimum weight, but at the same time a maximum degree of efficiency in the piano-specific frequency ranges. The adjustable magnetic systems used for driving the coils should be of high quality, and the driver magnets should have an assembly base that is as heavy as possible, in order to minimise energy loss.

In summary, the sensors 15 record the movements of the keys or the hammer heads or other movable parts in the action 11 of the pianoforte instrument 10. MIDI data is thereby generated. This data is used to retrieve the associated tone samples, by means of which selected additional sound energy is then delivered into the sound board 20, recorded in the sound sample memory 31. This additional sound energy supplements the vibration energy entering the sound board 20, in each case, via the vibrating acoustic strings, and enriches it in detail.

LIST OF REFERENCE NUMERALS

10 Pianoforte instrument
11 Action
15 Sensor
20 Sound board
25 Sound board driver system
26 Sound board driver system
30 Sound-augmenting device
31 Tone sample memory
33 Tone control device
34 Tone modification device
35 Control module
36 Amplifier unit
f Frequency in hertz (Hz)
t Time in seconds (s)
rS Relative sound pressure level in decibels (dB)
A Moment of impact of the hammer head
B Sound-formation phase
C End of the sound-formation phase
D Dying-out phase
E End of the dying-out phase
L Solid line
M Thick-dotted line
N Thin-dotted line

The invention claimed is:

1. Pianoforte instrument comprising:

an action with keys and including strings which are struck via a mechanism when the keys are actuated and are made to vibrate;

a sound board to which the vibrations of the strings are transmitted;

a sensor associated with each action for detecting actuation of only the associated key and for recording corresponding movement of the key to generate an individual sensor data signal;

a delivery device including a drive means for delivering additional vibration energy into the sound board;

and a controller for receiving the sensor data signal to, in turn, control the drive means;

said controller including a sound-augmenting device to which the measured values of the sensors are supplied, said sound-augmenting device including a memory device for compiling data corresponding to a desired sound characteristic in dependence on the measured values detected by the sensors and including a partial tone spectrum for each selected tone;

and wherein the sound-augmenting device supplies the sound board with additional vibration energy, corresponding to the data obtained, via the drive means.

2. Pianoforte instrument according to claim 1, characterised in that the vibration energy that is generated externally by the sound-augmenting device is delivered in real time into the sound board via the delivering device, in addition to the vibration energy entering the sound board mechanically from the vibrating acoustic strings.

3. Pianoforte instrument according to claim 1, characterised in that the memory device comprises a tone sample memory and in that tone samples are associated with the tones including the partial tones thereof from the tone sample memory, that correspond to the key actuations registered by the sensors in the action of the instrument.

4. Pianoforte instrument according to claim 1, including a tone modification device and an amplifier for amplifying the signals received from the tone modification device in order to deliver the amplified signal to the vibrating sound board.

5. Pianoforte instrument according to claim 4, characterised in that the signals issuing from the amplifier are supplied for delivering vibration energy that is converted into mechanical vibrations and introduced into the sound board.

6. Pianoforte instrument according to claim 1, characterised in that the device for delivering vibration energy comprises one or more driver systems.

7. Pianoforte instrument according to claim 1 wherein the sound-augmenting device includes a tone control device and the memory device includes a tone sample memory, the tone control device receiving the key actuation signals from the sensors and data from the tone sample memory, and wherein the sensor data signal and the tone sample memory output are generated in real time.

8. Pianoforte instrument according to claim 7 wherein the tone control device retrieves data from the tone sample memory as partials of each individual tone that correspond to the respectively acoustically sounding tone because of the related key struck and wherein the tone control device retrieves in addition the signal from the key or action sensors specifying the key struck and held down during generating the acoustically produced tone.

9. Pianoforte instrument according to claim 8 including a tone modification device and wherein the tone sample memory functions as an external data source for the supply of any combination of partials of each individual tone for further processing by means of the tone modification device to be finally supplied to the sound board.

10. Pianoforte instrument according to claim 7 including a tone modification device coupled from the tone control device and for modifying the data received from the tone control device to modify the partial tone spectrum of each individual tone.

11. Pianoforte instrument according to claim 1 characterised in that the sound augmenting device comprises a tone control device and the memory device includes a sample memory device memorizing individual tone partials, and in that the tone control device receives the key actuation data originating from the sensors and receives the individual tone partial data associated with the corresponding tone the individual tone partials from the tone sample memory.

12. Pianoforte instrument according to claim 1 wherein the sound-augmenting device includes a tone control device and the memory device includes a tone sample memory, the tone control device receiving and respectively combining the sensor data signal, as well as data from the tone sample memory, and wherein both the sensor data signal and tone sample memory output are generated in real time.

13. Pianoforte instrument according to claim 12 wherein the tone control device retrieves data from the tone sample memory as tones or partial tones of a tone that correspond in pitch to the respectively played tone that is sensed.

14. Pianoforte instrument according to claim 13 wherein the tone sample memory functions as an external data source for the supply of additional vibration energy to the sound board.

15. Pianoforte instrument according to claim 14 including a tone modification device coupled from the tone control device and for modifying the data received from the tone control device to modify the partial tone spectrum of each individual tone.

* * * * *